US005196148A

United States Patent [19]

Nigrelli

[11] Patent Number: 5,196,148

[45] Date of Patent: Mar. 23, 1993

[54] AERATOR

[75] Inventor: Nicholas R. Nigrelli, Kiel, Wis.

[73] Assignee: Nigrelli Systems Inc., Kiel, Wis.

[21] Appl. No.: 837,160

[22] Filed: Feb. 18, 1992

[51] Int. Cl.[5] ..... B01F 5/04

[52] U.S. Cl. ..... 261/76; 261/120; 261/DIG. 75; 261/DIG. 39

[58] Field of Search ..... 261/DIG. 75, DIG. 39, 261/76, 120

[56] References Cited

U.S. PATENT DOCUMENTS 3,012,676 12/1961 Englesberg ..... 261/DIG. 75
3,521,864 7/1970 Welles, Jr. ..... 261/DIG. 75
3,785,627 1/1974 Tuzson et al. ..... 261/DIG. 39
4,051,204 9/1977 Muller et al. ..... 261/DIG. 75
4,409,100 10/1983 Rajendren ..... 261/DIG. 75
4,514,343 4/1985 Cramer et al. ..... 261/76

*Primary Examiner*—Tim Miles
*Attorney, Agent, or Firm*—Francis J. Bouda

[57] ABSTRACT

The aspirator or air-injector of the present invention includes an air transport pipe disposed within a fluid transport tube. The end of the pipe which is disposed within the tube is cut at an angle to the axis of the pipe and provides a beveled face disposed within the tube, facing upstream of any fluid passing through the tube, and being rotated at an angle between 5 and 20 degrees.

4 Claims, 1 Drawing Sheet

AERATOR

BACKGROUND OF THE INVENTION

It is well-known in the art that certain bodies of water need to be aerated in order to preserve their clarity and cleanliness, as well as to enhance the environment, both from a visual and an odor standpoint.

Many types of sprays and injectors, circulating pumps, waterfalls and the like have been suggested, all of which are relatively complicated and expensive.

One of the simplest types of aerators is generally described as being a "Venturi"-type system. Such a device was shown more than 75 years ago in the Peterson U.S. Pat. No. 1,204,309.

Later disclosures of a similar construction are shown in Singleton U.S. Pat. No. 3,335,964; Wheat U.S. Pat. No. 3,606,166; Jooste U.S. Pat. No. 3,815,831; Hoff U.S. Pat. No. 3,920,037 and Troyen U.S. Pat. No. 4,494,567.

Although all of these disclosures present a variety of water aspirators utilizing a "Venturi"-type pipe, none describes the specific improvement of the present invention.

Although this is a relatively old and crowded field of art, the economies of construction and operation resulting from the use of the present invention are notably effective.

OBJECTS OF THE INVENTION

Therefore, one object of the present invention is to provide a device for aerating or aspirating open bodies of water which provides the maintenance-free, inexpensive and efficient adjustment for injecting a stream of air into a stream of water.

A further object of the present invention is to provide a "Venturi"-type aspirator of precise physical dimensions and arrangement to increase the efficiency and economy of operation.

Still another object of the present invention is to provide a maintenance-free, all-weather submersible aerator.

SUMMARY OF THE INVENTION

In the present invention, the aerator rests in a body of water, preferably suspended beneath a ring-like flotation device on the top of the water, but optionally at the bottom of the water.

The aerator includes a motor, an associated propeller, and also a tube suspended from a float which rests on the surface of the water. This float may be ring-like or any desired configuration. The aerator also includes a pipe, the upper end of which extends above any surface-water level and then descends downwardly (through the float) where the lower end enters the tube. The operation of the motor causes the propeller to force a stream of water through the tube against the lower end of the pipe disposed in the tube.

Because of the specific dimensions, location and orientation of the pipe within the tube, air is drawn downwardly through the pipe from the atmosphere, picked up by the stream of water forced through the tube by the propeller. The water is thereby aspirated or aerated as it is discharged from the tube.

Although I have preferred dimensions, positions and sizes and locations of the pipe within the tube, the pipe may be adjustable, both in an axial direction and a rotary direction, so that the open lower end of the pipe within the tube may be disposed in pre-use position with regard to the water-moving mechanism.

With the above and other objects in view, more information and a better understanding of the present invention may be achieved by reference to the following detailed description.

DETAILED DESCRIPTION

For the purpose of illustrating the invention, there is shown in the accompanying drawings a form thereof which is at present preferred, although it is to be understood that the several instrumentalities of which the invention consists can be variously arranged and organized and that the invention is not limited to the precise arrangements and organizations of the instrumentalities as herein shown and described.

In the drawings, wherein like reference characters indicate like parts:

Figure 1:
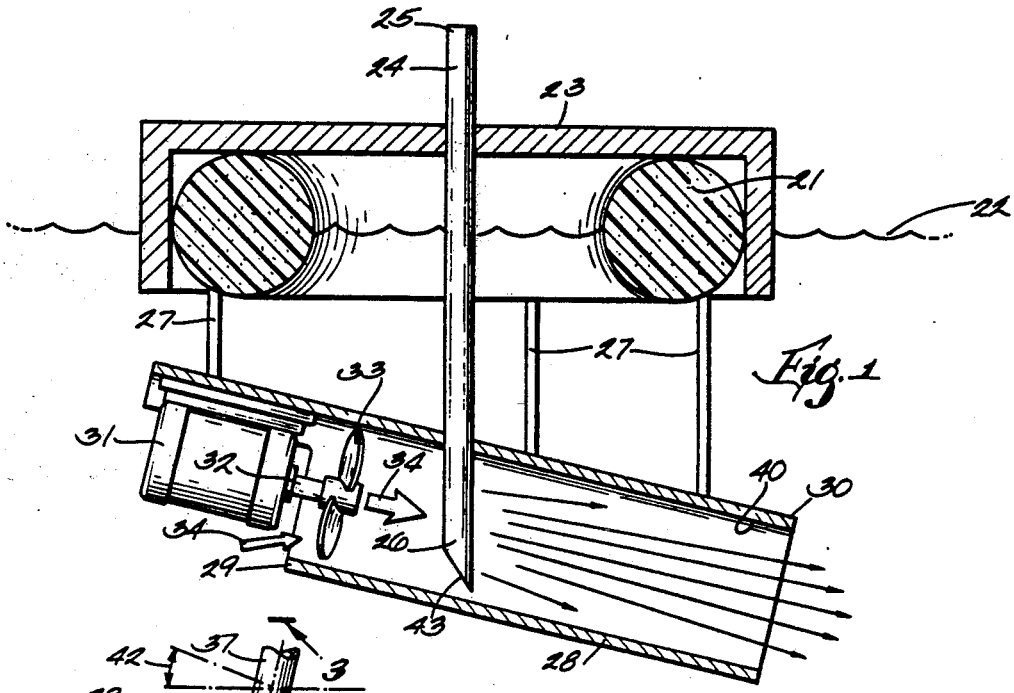
FIG. 1 is a schematic vertical cross-sectional view of the aerator assembly of the present invention.

Referring now to FIG. 1 there is shown a float 21 which may be a polypropylene, polystyene or other polymer member, such as a ring designed to float on the surface 22 of a pond of water. Desirably, the float 21 includes a cover 23, not only for decorative purposes, but also to support an aerator pipe 24 which hangs vertically therefrom with the upper end 25 disposed well above the surface of the water and the lower end 26 hanging downwardly within the body of water.

Also suspended from the float 21, as by brackets, cables, or other appropriate devices 27, is a motor 31 with its propeller 33, and a tube 28 through which the water is forced to pass.

The tube 28 preferably is suspended at an angle so that the intake or upper end 29 is higher than the lower or discharge end 30 as is clearly shown in FIG. 1.

Adjacent the tube 28, a submersible motor 31 is mounted. Preferably this is a fully-sealed motor which requires no maintenance. The motor 31 drives a propeller 33 through a shaft 32 so that when actuated, the motor 31 rotates the propeller 33 and causes a stream of water to flow into and through the tube 28 in the direction of the arrow 34.

As the stream impacts the lower end 26 of the pipe 24, air is drawn through the pipe from the upper end 25 into the stream of water, where the water becomes aerated and is discharged from the discharge end 30 of the tube 28 with a desirable quantity of air entrained therein.

Figure 2:
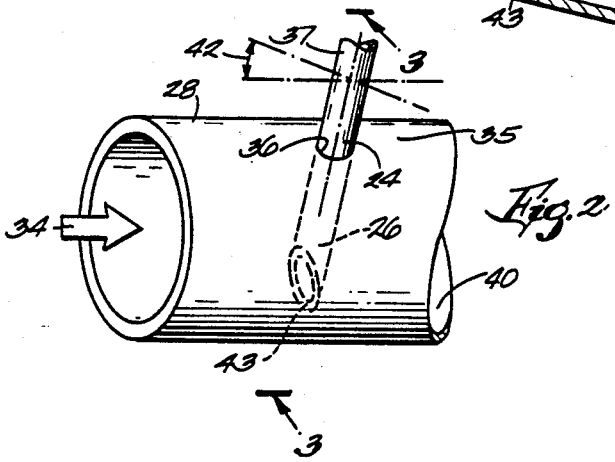
FIG. 2 is a fragmentary view showing the aspirator pipe mounted in the fluid tube.
Figure 3:
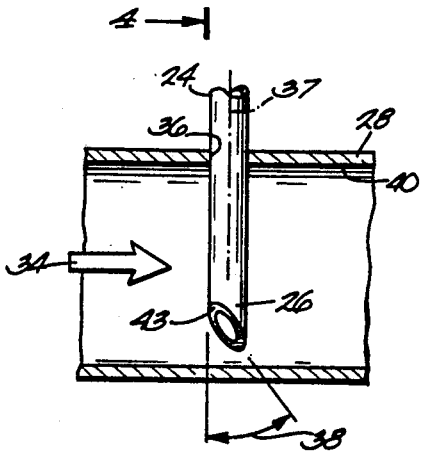
FIG. 3 is a cross-sectional view taken generally along line 3—3 of FIG. 2.
Figure 4:
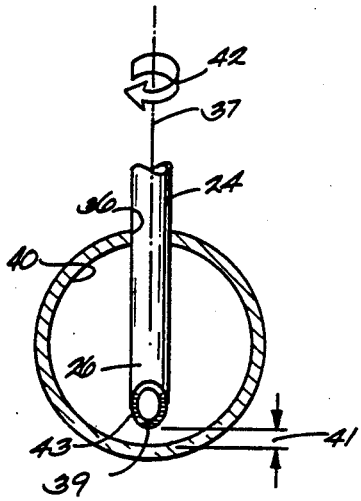
FIG. 4 is a cross-sectional view taken generally along line 4—4 of FIG. 3.

Referring now to FIGS. 2, 3, and 4, the pipe 24 enters the side wall 35 of the tube 28 through an opening 36.

In one embodiment, the pipe 24 may be welded or securely fastened in the opening 36, or it may be arranged to be movable and adjustable in order to change the position and disposition of the lower end 26 of the pipe 24. It is the rotated angle of the pipe in the tube which is important.

As is shown particularly in FIGS. 3 and 4, the lower end 26 of the pipe 24 is cut with a flat face at an angle to the axis 37 of the pipe 24 to provide an acute angle 38.

Referring now to FIG. 4, it can be seen that the tip 39 of the lower end 26 of pipe 24 is spaced from inner wall 40 of the tube 28. This dimension 41, shown in FIG. 4, preferably is about ½" but may be selectively chosen as desired, depending upon the dimensions of the pipe and the tube, and the volume of water being forced therethrough by the propeller 33.

The pipe 24 is supported in the tube 28 with the flat face facing generally upstream of the oncoming water. In addition, the pipe 24 is rotated slightly about its axis 37 through an angle 24 shown in FIGS. 2 and 4, so that the face 43 is disposed at a slight angle to the body of water forced through the tube by the propeller 33.

I have found for optimum operations, the angle 42 must be precise to provide a more efficient and economical aspirating operation.

As an example, in an aspirator to move about 250 gallons per minute, where the inner diameter of the tube is about 5½" and the pipe diameter about 1⅜", the angle 42 is approximately 15°, the angle 38 approximately 30°, and the distance 41 approximately ½".

When the motor 31 operates at 3400 RPM's, the bubble size created in the water is most efficient and desirable, and provides the appropriate number of pounds of oxygen per horsepower per hour, per parts per million of water.

It is to be understood that the present invention may be embodied in other specific forms without departing from the spirit or special attributes hereof, and it is therefore desired that the present embodiments be considered in all respects as illustrative, and therefore not restrictive, reference being made to the appended claims rather than to the foregoing description to indicate the scope of the invention.

Having thus described my invention what is claimed as new and desired to protect by Letters Patent are the following:

1. In an aspirator, air-injector aerator or the like, a fluid-transport tube having an upstream or intake end and also a downstream or discharge end, an air transport pipe connected to said tube with one end thereof disposed within said tube, the end of said pipe disposed within said tube being cut at an angle to the axis of the pipe to provide a face and disposed within said tube with the tip of the cut end being spaced between ¼" and 1" of the inner wall of said tube, the face of said cut end of said pipe facing upstream, said pipe being rotated about its axis so that the cut face is disposed at an angle to the upstream direction, and the rotated angle of said pipe being between 5 degrees and 20 degrees.

2. The aspirator of claim 1 wherein said rotated angle of said pipe is 15°.

3. The aspirator of claim 1 wherein said pipe may be adjustable rotated about its own axis while supported by said tube.

4. The aspirator of claim 1 wherein said pipe is immovably supported in said tube with its face at an angle to the upstream direction.

* * * * *